US006652920B2

(12) United States Patent
Carbonell et al.

(10) Patent No.: US 6,652,920 B2
(45) **Date of Patent: *Nov. 25, 2003**

(54) METHOD FOR MENISCUSCOATING A SUBSTRATE WITH A POLYMERIC PRECURSOR

(75) Inventors: Ruben G. Carbonell, Raleigh, NC (US); Joseph M. DeSimone, Chapel Hill, NC (US); Brian J. Novick, Raleigh, NC (US)

(73) Assignees: North Carolina State University, Raleigh, NC (US); The University of North Carolina at Chapel Hill, Chapel Hill, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/207,294

(22) Filed: Jul. 29, 2002

(65) Prior Publication Data

US 2003/0134049 A1 Jul. 17, 2003

Related U.S. Application Data

(63) Continuation of application No. 09/589,557, filed on Jun. 7, 2000, now Pat. No. 6,497,921, which is a continuation-in-part of application No. 09/188,053, filed on Nov. 6, 1998, now Pat. No. 6,083,565.

(51) Int. Cl.[7] ..... B05D 1/18

(52) U.S. Cl. ..... 427/430.1; 427/495; 427/498; 427/512; 427/434.2; 427/434.6

(58) Field of Search ..... 427/430.1, 495, 427/498, 512, 434.2, 434.6

(56) References Cited

U.S. PATENT DOCUMENTS

| | | | | |
|---|---|---|---|---|
| 3,501,390 A | * | 3/1970 | Turner | 204/478 |
| 4,436,764 A | * | 3/1984 | Nakazima et al. | 427/512 |
| 4,992,308 A | | 2/1991 | Sunol | 427/297 |
| 5,169,687 A | | 12/1992 | Sunol | 427/297 |
| 5,496,901 A | | 3/1996 | DeSimone | 526/89 |
| 5,508,060 A | * | 4/1996 | Perman et al. | 427/2.14 |
| 5,512,058 A | | 4/1996 | Gavend et al. | 8/94.18 |
| 5,709,910 A | | 1/1998 | Argyle et al. | 427/434.2 |
| 5,863,612 A | | 1/1999 | DeSimone | 427/422 |
| 6,001,418 A | | 12/1999 | DeSimone et al. | 427/240 |
| 6,497,921 B1 | * | 12/2002 | Carbonell et al. | 427/430.1 |

FOREIGN PATENT DOCUMENTS

| | | |
|---|---|---|
| DE | 4238620 A1 | 5/1994 |
| EP | 0677332 A2 | 10/1995 |
| WO | WO 90/02612 | 3/1990 |
| WO | WO 93/14255 | 7/1993 |
| WO | WO 94/18264 | 8/1994 |
| WO | WO 97/17143 | 5/1997 |
| WO | WO 98/11293 | 3/1998 |
| WO | WO 98/54397 | 12/1998 |
| WO | WO 99/19080 | 4/1999 |
| WO | WO 99/30840 | 6/1999 |
| WO | WO 00/27544 | 5/2000 |

OTHER PUBLICATIONS

Hawley's Condensed Chemical Dictionary, Twelfth Edition, Van Nostrand Reinhold Company, 1993, p. 28. (No month date).*

Schunk et al.; *Free–Meniscus Coating Processes, Liquid Film Coating, Chapman & Hall, Ed: Stephan F. Kistlec & Peter M. Schweizer (1997) Review of Dip Coating*, pp. 673–708. (No month date).

International Search Report corresponding to PCT/US01/17310; Date of Mailing: May 14, 2002.

* cited by examiner

*Primary Examiner*—Katherine A. Bareford
(74) *Attorney, Agent, or Firm*—Myers Bigel Sibley & Sajovec, P.A.

(57) ABSTRACT

A method of coating a substrate comprises immersing a surface portion of a substrate in a first phase comprising carbon dioxide and a coating component comprising a polymeric precursor; then withdrawing the substrate from the first phase into a distinct second phase so that the coating component is deposited on the surface portion; and then subjecting the substrate to conditions sufficient to polymerize the polymeric precursor and form a polymerized coating.

24 Claims, 7 Drawing Sheets

Water on PMMA after cleaning with solvent

Water on PMMA

METHOD FOR MENISCUSCOATING A SUBSTRATE WITH A POLYMERIC PRECURSOR

CROSS-REFERENCE TO RELATED APPLICATIONS

The present application is a continuation of Ser. No. 09/589,557 filed Jun. 7, 2000, allowed, now U.S. Pat. No. 6,497,921 which is a continuation-in-part application of Ser. No. 09/188,053 filed Nov. 6, 1998, now U.S. Pat. No. 6,083,565, the disclosures of which are incorporated herein by reference in their entireties.

FIELD OF THE INVENTION

The present invention relates to meniscus coating methods and apparatus.

BACKGROUND OF THE INVENTION

There are three forms of meniscus coating processes which are commonly grouped under the term "free meniscus coating": Withdrawal processes, drainage processes, and continuous processes. Many other coating processes use a meniscus to produce films on the substrate to be coated. These include roll coating, blade coating, and slot coating.

Withdrawal coating (often referred to as dip coating) is the most common free meniscus technique used in both laboratories and industry because of its simplicity and cost. Continuous coating is often desirable because of higher output, but the complicated engineering involved often prevents it from being utilized. Drainage is based upon the same principles as withdrawal and is advantageous when space is limited since it requires no mechanical lifting mechanism. See, e.g., C. Brinker et al., in *Liquid Film Coating*, 673–708 (S. Kistler and P. Schweizer eds. 1997).

In general, free meniscus coating is a solvent intensive process and accounts for a considerable use of environmentally undesireable solvents. Accordingly, there is a need for new free meniscus coating methods and apparatus that reduce or eliminate the use of solvents such as VOCs and the use of solvents such as CFC, HCFC, HFC, or PFC solvents, as well as aqueous solvents.

SUMMARY OF THE INVENTION

In one aspect, the invention provides a method of coating a substrate. The method comprises immersing a surface portion of a substrate in a first phase comprising at least one coating component which is a polymeric precursor; then withdrawing the substrate from the first phase into a distinct second phase so that the at least one coating component is deposited on the surface portion; and then subjecting the substrate to conditions sufficient to polymerize the at least one coating component and form a polymerized coating.

The foregoing and other objects and aspects of the present invention are explained in greater detail in the drawings herein and the specification set forth below.

DETAILED DESCRIPTION OF THE PREFERRED EMBODIMENTS

Figure 1:
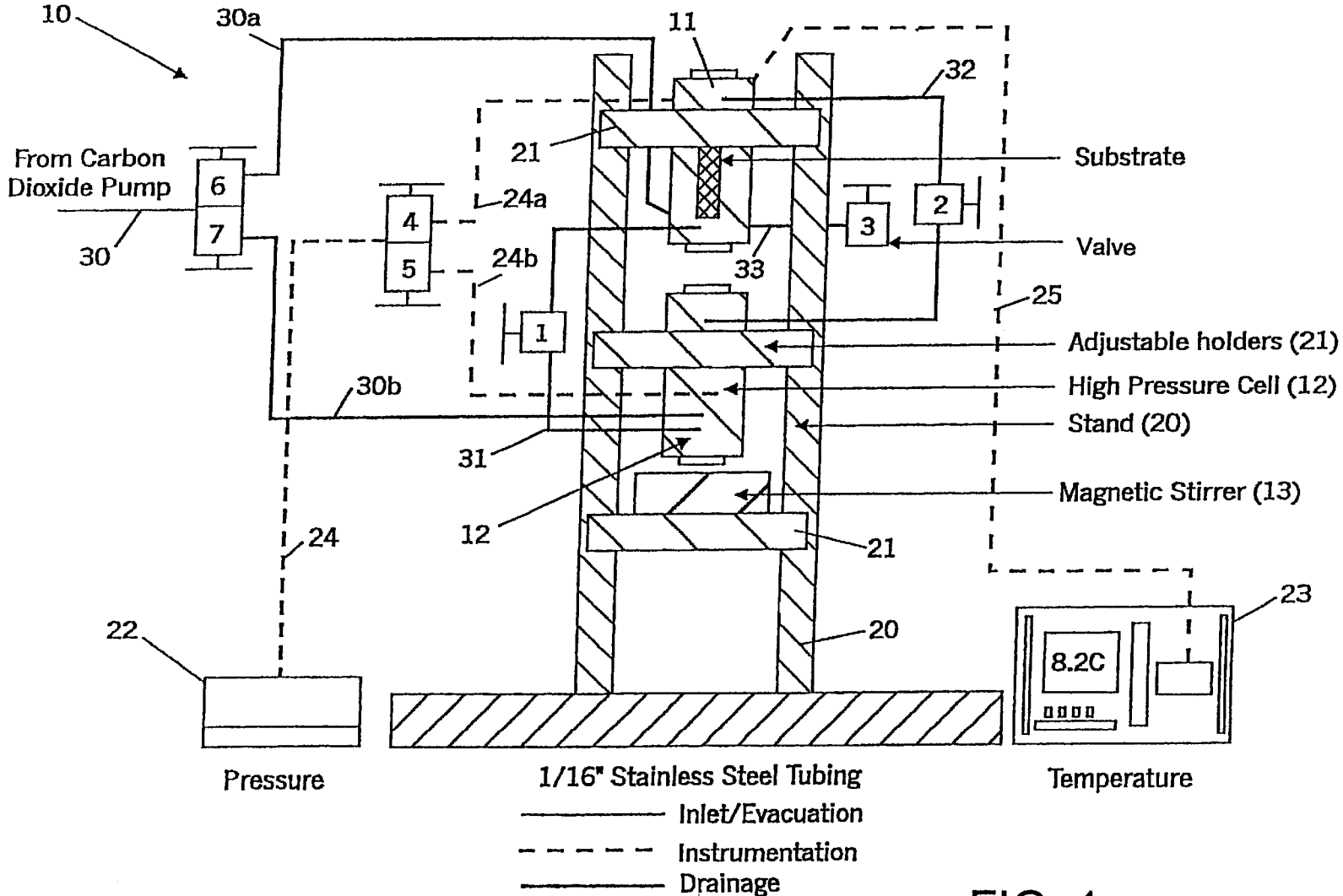
FIG. 1 is an illustration of an apparatus useful for carrying out the present invention.

The present invention will now be described herein with respect to the foregoing preferred embodiments including various examples. These embodiments are designed to illustrate the invention, and do not limit the invention as defined by the claims.

Substrates that may be coated by the present invention include, but are not limited to, solid substrates, textile substrates, and fiber substrates. The surface portion of the substrate that is coated may be the entire surface of the substrate or any region thereof, such as one side of the substrate, a major or minor portion of the substrate surface, etc.

Solid substrates or articles may be porous or nonporous and are typically formed from metal, semiconductor (such as a silicon wafer) glass, ceramic, stone, composites (typically formed from materials such as carbon fiber, glass fiber, kevlar fiber, etc. filled with a material such as epoxy resin), polymers such as thermoset and thermoplastic polymers (which may be provided in any form such as a polymer film, a molded article, etc.), wood (including but not limited to veneer and plywood), paper (including but not limited to cardboard, corrugated paper and laminates), etc. Such solid substrates may take any form, including electronic components such as circuit boards, optical components such as lenses, magnetic hard disks, and photographic film. Porous materials may include, for example, powders, nanoparticles, macroparticles, fibrous material, biomolecules, etc. Granules and metal particles are encompassed as porous materials. The porous materials may be present in a number of shapes such as, without limitation, spherical and nonspherical. With respect to porous substrates, the substrate can serve as a matrix, and a coating component comprising a polymeric precursor may be placed thereon according to the methods of the invention. The polymeric precursor can then be polymerized such that the substrate and polymerized coating together form an integral composite structure.

Fibers are linear materials (with or without sizing) that have not yet been formed into textile materials, and include natural and synthetic fibers such as wool, cotton, glass and carbon fibers. The fibers may be in any form, such as thread, yarn, tow, etc.

Fabrics or textiles that may be coated by the method of the invention include woven (including knit) and nonwoven fabrics or textiles, formed from natural or synthetic fibers as discussed above, as well as other nonwoven materials such as glass mats.

Wallpaper and carpet (particularly the back surface of carpet) may also be coated by the method of the present invention, for example to apply a stain-resistant fluoropolymer coating to the wallpaper.

The thickness of the coating formed on the subject after evaporation of the carrier solution (the carbon dioxide along with any other compressed gases or cosolvents) will depend upon the particular coating component employed, the substrate employed, the purpose of the process, etc., but can range between about five or ten Angstroms up to one or five millimeters or more. Thus, the present invention provides a means for forming on substrates uniform thin films or layers having thicknesses of five or ten Angstroms up to 500 or 1,000 Angstroms, uniform intermediate thickness films or layers of having thicknesses of about 500 or 1,000 Angstroms up to 5, 10 or 100 microns, and uniform thick films having thicknesses of about 10, 100 or 200 microns up to 1 or even 5 millimeters. In general, the thickness of the films tends to depend on a number of factors such as, without limitation, concentration, withdrawal velocity, and evaporation rate.

Coating components that may be coated on substrates by the present invention include adhesives such as ethylene vinyl acetate copolymer polymers such as conductive polymers, antiglare materials, optical coatings, antireflective coatings, lubricants, low or high dielectric materials, etc. More particularly, the coating component may be a polyurethane, a sol-gel precursor, a polyimide, an epoxy, a polyester, a polyurethane (such as, but not limited to, diisocyanatomethylbenzene, diisocyanatophenylmethane, 1,6-diisocyanatohexane, etc.), a polycarbonate, a polyamide, a polyolefin, a polystyrene, acrylic latex epoxy resins, novolac resins, resole resins, polyurea, polyurea urethanes, polysaccharides (such as cellulose and starch), etc. For the purposes of the invention, the term "polymeric precursor" refers to any component capable of undergoing polymerization including, but not limited to, monomers, oligomers, and polymers. In the instance of polymers, the method of the invention allows them to be polymerized to a greater degree. Polymeric precursors such as, for example, acrylic monomers (e.g., methyl methacrylate, butyl acrylate, ethylhexyl acrylate, hydroxyethyl methacrylate, hydroxypropyl acrylate), polyfunctional small molecules can also be used. Multi-functional monomers capable of chemically crosslinking can also be employed as polymeric precursors such as, without limitation, diglycidalether of bisphenol A and ethylene glycol dimethacrylate. Crosslinked coatings formed therefrom are advantageous in that they are capable of displaying solvent resistance and abrasion resistance. Epoxy-functionalized resins, isocyanate-containing precursors, lipids, fatty acids, and the like can also be employed as precursors. Other polymeric precursors include, without limitation, fluoropolymers (e.g., perfluoropolyethers, poly(chlorotrichlorotrifluoroethylene), poly(tetrafluoroethylene)), polyesters, silicone resins (e.g., poly(dimethylsiloxane), poly(dimethoxysiloxane), silsesquixoanes, alkyl silicates), and amino resins (urea formaldehyde, triazine resins), poly(ethylene naphthalate). Mixtures of any of the above can be utilized. The amount of the coating component contained in the liquid will depend upon the particular object of the process, the thickness of the desired coating, the substrate, etc., but is in general from about 0.001, 0.01 or 0.1 percent to 10, 20, or 40 percent by weight (or more, particularly in the case of melts as described below). In one embodiment, the weight percent of the polymeric precursor in the first phase can range from 0 to 20 percent, more preferably 6 percent by weight based on the weight of the first phase (e.g., carbon dioxide). The polymerized coating may be chemically crosslinked or physically crosslinked.

Polymers and polymer-containing materials formed from the polymeric precursor according to the invention and contained in the polymerized coating are numerous and known to one skilled in the art, as well as applications employing such polymers. These include, without limitation, unsaturated or saturated polyester resins (e.g., coil coating, can coating, automotive finishes, heavy equipment finishes, household appliances, radiators, office equipment, steel cabinets, tools, agriculture, construction, bicycle frames, wood finishes, powder coatings, ink binders, electrical components, and the like); alkyd polyester resins (e.g., building paints, marine coatings, primers, wood varnish, binders for air/oven coatings, fridges, automotive topcoats, and the like); amino resins (e.g., glues, paper impregnation, heat/acid curable, molding, foams, textiles, leather, adhesives, automotives, fridges, washing machines, and the like); phenolics (e.g., laminates, wood sizing, melting powders, insulating, crosslinkers for other resins, furniture polish, paints, drying lacquers, dye binders, ballpoint inks, primers, grinding wheels, reinforcing resins, electronic specialty applications, putties, anticorrosion, foodstuff packaging, metal primers, and the like); ketone aldehydes (e.g., sealing compounds, which may be used with other binders; polyisocyanates (automotive finishes, aircraft, heavy machinery, top coats, plastic coatings, housing finishes for electronic equipment, appliances, signs, wall cladding, resistance to chemicals, food hygiene equipment, weather stability coatings, furniture finishes, decorative coatings, impregnation of floor materials and wall materials, corrosion protection, industrial finishes, coil coatings, package coatings, insulation for electrical wires, and the like); epoxies (e.g., surface coatings, electrical and electronics, molding compounds, composites, adhesives, and the like). Combinations of the above polymers may be formed according to the invention. In various embodiments, the polymerized coatings are advantageous in that, depending on the end use application, they are capable of providing excellent properties relating to, for example, anti-corrosion, structural/protective, non-wetting, hardness, scratch resistance, solvent resistance, as well as others.

Various crosslinkers can be used in forming the polymerized coating. For example, in forming saturated or unsaturated polyesters, crosslinkers such as p-toluene sulphonic acid can be used as well as other acidic crosslinkers such as, without limitation, naphthalene sulphonic acid, alkyl naphthalene sulphonic acid, metal salts including dibutyltin dilaurate, zinc octoate, and tertiary amines. Additional additives can be used in the first phase when forming the polymerized coating. Such additives include, without limitation, acrylic or silicone segments (e.g., alkoxysiloxanes and alkoxypolysiloxanes), styrene, silicones, urethanes, epoxies, and the like.

The step of subjecting the substrate to conditions sufficient to polymerize may be performed by various in-situ (e.g., batch, continuous, or semi-continuous) or ex-situ curing techniques known to one skilled in the art. These techniques include, but are not limited to, ultraviolet (UV)/visible, laser, thermal, ebeam, x-ray, microwave, infrared (IR), and oxidation/reduction. The curing may take place in the presence or absence of masks or lithography. The polymerization may take place under a variety of processing conditions. A preferred temperature range is from about 0° C. to about 1500° C., and more preferably from about 25° C. to about 100° C.

Curing of the polymeric precursor may also take place in the presence of an initiator provided in the first phase, the selection of which is known to the skilled artisan. Examples of an initiator include, without limitation, organic peroxide compounds. Exemplary organic peroxides that may be used include, for example, cumene hydroperoxide; methyl ethyl ketone peroxide; benzoyl peroxide; acetyl peroxide; 2,5-dimethylhexane-2,5-dihydroperoxide; tert-butyl peroxybenzoate; ditert-butyl periphthalate; dicumyl peroxide; 2,5-dimethyl-2,5-bix(tertbutylperoxide)hexane; 2,5-dimethyl-2,5-bis(tert-butylperoxy)hexyne; bix (tertbutylperoxyisopropyl)benzene; ditert-butyl peroxide; 1,1-di(tert-amylperoxy)cyclohexane; 1,1-di-(tert-butylperoxy)-3,3,5-trimethylcyclohexane; 1,1-di-(tert-butylperoxy)-cyclohexane; 2,2-di-(tert-butylperoxy)butane; n-butyl-4,4-di(tert-butylperoxy)valerate; ethyl-3,3-di-(tert-amylperoxy)butyrate; ethyl-3,3-di(tert-butylperoxy)-butyrate; t-butyl peroxy-neodecanoate; di-(4-5-butylcyclohexyl) peroxydicarbonate; lauryl peroxyde; 2,5-dimethyl-2,5-bis(2-ethyl-hexanoyl peroxy) hexane; t-amyl peroxy-2-ethylhexanoate; 2,2'-azobis(2-methylpropionitrile); 2,2'-azobis(2,4-methlbutanenitrile); and the like. Photoinitiators can also be employed, the selection of which are known to one skilled in the art. Examples of photoinitiators include, without limitation, benzoin ether, benzil dimethyl ketone acetal, 1-hydroxycyclohexyl phenyl ketone, benzophenone, and methyl thioxanthone. A preferred initiator is azobisisobutyronitrile.

The initiator can be used in various amounts. Preferably, the initiator is used in an amount ranging from about 0.01 to about 10 mole percent relative to the polymeric precursor.

The first phase may also include other components, examples of which are set forth in U.S. Pat. No. 6,001,418 to DeSimone et al., the disclosure of which is incorporated herein by reference in its entirety. Exemplary other components include, without limitation, one or more cosolvents, and one or more compounds to be carried in the first phase. Exemplary compounds to be carried in the first phase include, without limitation, resists (e.g., photoresists, electron resists, x-ray resists), adhesion promoters, antireflective coatings, and sol-gel precursors. Resists such as photoresists may also contain additives to improve lithographic performance including dissolution inhibitors, photo acid generators, and the like. The photo acid generators are present to allow for chemically amplified resist technology. The mixture may be in any physical form, including solutions, dispersions, and emulsions, but preferably the mixture is a solution. In one embodiment, the mixture may comprise carbon dioxide and a fluoropolymer as the polymerization product described in U.S. Pat. No. 5,496,901 to DeSimone, the disclosure of which is incorporated herein by reference in its entirety.

The first phase may contain various components which, upon polymerization of the polymeric precursor, become contained within the polymerized coating. Stated differently, such components are present within the structure of the polymerized coating. Examples of such components include, without limitation, biological materials such as, for example, proteins (antibodies, enzymes, etc.), peptides, amino acids, nucleic acids, cellular material, lipids, fatty acids bacteria, viruses, etc.

Examples of specific biological materials that can possibly be used include, without limitation, Anti-BaP antibody, Cellobiose Dehydrogenases, β-Glucosidase, Glucose Oxidase/Catalase, Ascorbate Oxidase, Cholesterol Oxidase+Catalase 1^8 53+100, Cholesterol Oxidase, Cholesterol Esterase, Sucrose Invertase, Creatine Creatinase+Sarcosin Oxidase+Catalase, Creatinine Creatinine Iminohydrolase, NADH Dehydrogenase, Alcohol Oxidase+Catalase, Glucose Oxidase+Catalase, Glucose Hexokinase, β-Lactamase, Lactate Dehydrogenase, Lactate Oxidase+Catalase, Oxalate Oxidase, Oxalate Decarboxylase, Pyrophosphatase, Trypsin, Lipoprotein Lipase, Urease, Uricase, Amylase, Betaine, Bromelain, Cellulase, Lipase, Papain, Prolase, Protease, Actin, Adenosine Deaminase, Agarase, Beta, Albumin, Bovine Serum, Alcohol Dehydrogenase, Aldolase, Amino Acid Oxidase, D-Amino Acid Oxidase, L-Amylase, Alpha Amylase, Beta Arginase, Asparaginase, Aspartyl Aminotransferase, Avidin, Carbonic Anhydrase, Carboxypeptidase A, Carboxypeptidase B, Carboxypeptidase Y, Casein, Alpha, Catalase, Cellulase, Cholesterol Esterase, Cholinesterase, Acetyl, Cholinesterase, Butyryl, Chymotrypsin, Clostripain, Collagen, Collagenase, Concanavalin A, Creatine Kinase, Deoxyribonuclease I, Deoxyribonuclease II, Deoxyribonucleic Acids, DNA Ligase, T4 DNA Polymerase I, DNA Polymerase, T4, Dextranase, Diaphorase, Elastase, Elastin, Galactose Oxidase, Galactosidase, Beta Glucose Oxidase, Glucose-6-Phosphate Dehydrogenase, Glucosidase, Beta, Glucuronidase, Beta, Glutamate Decarboxylase, Glyceraldehyde-3-Phosphate Dehydrogenase, Glycerol Dehydrogenase, Glycerol Kinase, Hemoglobin, Hexokinase Histone, Hyaluronic Acid, Hyaluronidase, Hydroxysteroid Dehydrogenase, Lactate Dehydrogenase, Lactate Dehydrogenase, L-Lactoperoxidase, Leucine Aminopeptidase, Lipase, Luciferase, Lysozyme, Malate Dehydrogenase, Maltase, Mucin, NADase, Neuraminidase, Nitrate Reductase, Nuclease, Micrococcal, Nuclease, S1, Ovalbumin, Oxalate Decarboxylase, Papain, Pectinase, Pepsin, Peroxidase, Phosphatase, Acid, Phosphatase, Alkaline, Phosphodiesterase I, Phosphodiesterase II, Phosphoenolpyruvate Carboxylase, Phosphoglucomutase, Phospholipase A2, Phospholipase C, Plasma Amine Oxidase, Pokeweed Antiviral Toxin, Polynucleotide Kinase, T4, Polyphenol Oxidase, Protease, S. aureus, Proteinase K, Pyruvate Kinase, Reverse Transcriptase Ribonuclease, Ribonuclease T1, Ribonucleic Acid, RNA Polymerase, RNA Polymerase, T7, Superoxide Dismutase, Trypsin, Trypsin Inhibitors, Tyrosine Decarboxylase, Urease, Uricase, Xanthine Oxidase, Aat II, Acc I, Acc III Acc65 I, AccB7 I, Age I Alu I, Alw26 I, Alw44 I Apa I, Ava I, Ava II, Bal I, BamH I, Ban I, Ban II, Bbu I, Bcl I, Bgl, Bgl II, BsaM I, BsaO I Bspl286 I, BsrBR I, BsrS I, BssH II, Bst71 I Bst98 I, BstE II, BstO I, BstX I, BstZ I, Bsu36 I, Cfo I Cla I Csp I Csp45 I, Dde I Dpn I Dra I, EclHK I, Eco47 III Eco52 I, Eco72 I EcolCR I, EcoR I EcoR V, Fok I 4-Core® Buffer Pack, Hae II, Hae III, Hha I Hinc II, Hind III, Hinf I Hpa I, Hpa II, Hsp92 I, Hsp92 II, Kpn I, Mbo I, Mbo II Mlu I, Msp I MspA1 I, Nae I, Nar I, Nci I, Nco I, Nde I, Nde II, NgoM I, Nhe I, Not I, Nru I, Nsi I, Ppo I (Intron-Encoded Endonuclease) Pst I Pvu I Pvu II, Rsa I, Sac I, Sac II, Sal I, Sau3A I Sau96 I, Sca I, Sfi I, Sgf I Sin I, Sma I, SnaB I Spe I Sph I, Ssp I, Sty I, Vsp I, Xba I, Xho I, Xho II, Xma I, Xmn I, Pfu DNA Polymerase, Tfl DNA Polymerase, Tfl DNA Polymerase Mini Kits, Tli DNA Polymerase Tth DNA Polymerase, DNA Polymerase, DNA Polymerase I, Klenow Fragment, Exonuclease Minus, DNA Polymerase I, DNA Polymerase I Large (Klenow) Fragment, DNA Polymerase I Large (Klenow) Fragment Mini Kit, T4 DNA Polymerase, SP6 RNA Polymerase, T3 RNA Polymerase, T7 RNA Polymerase, Reverse Transcriptases, T4 DNA Ligase, T4 RNA Ligase, T4 Polynucleotide Kinase, Exonuclease III, Mung Bean Nuclease, Ribonuclease H, RNase ONETM Ribonuclease, RQ1 Rnase, S1 Nuclease, Alkaline Phosphatase, Agarose Digesting Enzyme, Chloramphenicol Acetyltransferase, RecA Protein, Thioredoxin, *E. coli*, Recombinant Topoisomerase I, Ribonuclease Inhibitor, YTS 109.8.1.1, YTS 111.4.2, YTS 148.3.2.1, YTS 154.7.7.10, YBM 29.2.1, YCTLD 45.1, YCTLD 160.101, YSM 46.7, YTS 121.5.2, YTS 166.2.16, YTS 191.1.2, YTS 177.9.6.1, YTA 3.1.2, YTS 169.4.2.1, YTS 105.18.10, YTS 156.7.7, YBM 15.1.6, YBM 6.1.10, YTS 213.1.1, YMSM 636.4, YBM 42.2.2, YW 62.3.20, YTS 165.1, YW 13.1.1, YBM 10.14.2, YBM 5.10.4, YTA 74.4.4, YTA 94.8.10, YLAG 77.5, YKIX 302.9.3, YKIX 322.3.2, YCATE 55.9.1, YKIX 490.6.4, YKIX 337.8.7, YKIX 716.13.2, YKIX 753.22.2, YKIX 739.46, YKIX 337.217, YKIX 334.2.4, YNB 46.1.8, YTH 30.15, YTC 182.20, YTC 141.1HL, YTH 81.5, YFC 120.5, YFC 118.33, YTH 906.9HL, YTH 913.12, YTH 24.5, YTH 80.103, YTH 66.9, YTH 34.5, YTH 53.1, YTH 71.3, YTH 8.18, YTH 862.2, L or R-Ornithine, L or R-Arginine, L or R-L or Rysine, L or R-Histidine, L or R-Aspartic Acid, L or R-Threonine, L or R-Serine, L or R-GL or Rutamic Acid, L or R-ProL or Rine, L or R-Tryptophan, L or R-AL or Ranine, L or R-Cystine, L or R-GL or Rycine, L or R-VaL or Rine, L or R-Methionine, L or R-IsoL or Reucine, L or R-L or Reucine, L or R-Tyrosine, L or R-PhenyL or RaL or Ranine, L or R-Camitine, L or R-Cysteine, and L or R-NorL or Reucine.

Combinations of the above can also be employed. The polymerized coating that contains a biological material is advantageous in that such a structure may function as a biological sensor, i.e., the surface may be used to measure the concentration of metabolites and drugs in plasma blood serum and other biological fluids.

The carbon dioxide liquid or supercritical fluid may be in any suitable form, such as a solution or a heterogeneous system (e.g. a colloid, a dispersion, an emulsion, etc.). Liquid systems are preferred for such solutions or heterogeneous systems. The liquid may be a melt of a coating component (e.g., a polymer such as polycarbonate), which has been heated to melt that component and then swollen by the addition of liquid or supercritical carbon dioxide to decrease the viscosity thereof. Supercritical fluids are preferably used with such melts. The liquid may contain a giant aggregate or molecule (the "gel") that extends throughout a colloidal dispersion (or "sol", as in liquids used to form sol-gel films.

Carbon dioxide is a gas at standard pressures and temperatures. One feature of a free meniscus coating method of the present invention is, accordingly, that the carbon dioxide system is provided to the substrate as a liquid. This is necessary because the liquid must spread on the substrate and the volatile components must evaporate from the substrate leaving behind the non-volatile film-forming material. Where the carbon dioxide is utilized as a solvent, this is also necessary to prevent the carbon dioxide from evaporating too quickly to remove the compound to be removed from the substrate.

In one embodiment, the carbon dioxide liquid is comprised of carbon dioxide and a fluoropolymer, and more preferably a fluoroacrylate polymer, as the coating component, so that the substrate is coated with the fluoropolymer or fluoroacrylate polymer. Examples of such mixtures are disclosed as the polymerization product described in U.S. Pat. No. 5,496,901 to DeSimone, the disclosure of which is incorporated herein by reference in its entirety.

In another embodiment, the carbon dioxide liquid is comprised of carbon dioxide and a carbon dioxide insoluble polymer as the coating component dispersed in the carbon dioxide to form a heterogeneous mixture such as a colloid, dispersing being done by the application of shear forces (such as by stirring with a stirrer) or by the addition of surfactants, such as those disclosed in U.S. Pat. Nos. 5,312,882 or 5,676,705, the disclosures of which are incorporated herein by reference in their entirety. This technique enables the coating of substrates with carbon dioxide insoluble polymers.

In another embodiment, the first phase is a liquid melt of a polymer that contains or is swollen with liquid or supercritical carbon dioxide, as noted above. The first phase may thus be heterogeneous or homogeneous. This embodiment is particularly useful for polymers that are not soluble in the carbon dioxide, but can be swollen with carbon dioxide to reduce the viscosity of the polymer. In this embodiment, the second phase may be either a gas or supercritical carbon dioxide.

The carbon dioxide liquid may contain a viscosity modifier such as an associative polymer to increase the viscosity thereof and alter the thicknesss of the surface coating. The viscosity modifier may, for example, be included in an amount sufficient to increase the viscosity of the carbon dioxide liquid up to about 500 or 1000 centipoise.

The carbon dioxide liquid may contain a surface tension modifier (e.g., a surfactant) to increase or decrease the surface tension by an amount up to about plus or minus 5 dynes per centimeter. Surfactants used as such surface tension modifiers should include a $CO_2$-philic group and a $CO_2$-phobic group and are known in the art. See, e.g., U.S. Pat. No. 5,312,882 to DeSimone et al.; U.S. Pat. No. 5,683,977 to Jureller et al. (the disclosures of which are incorporated by reference herein in their entirety).

The carbon dioxide liquid may contain a co-solvent that evaporates more slowly than does carbon dioxide (e.g., alcohols, ketones such as cyclopentanone, butyl acetate, xylene). Substrates coated with such a carbon dioxide liquid may then be removed from the pressure vessel and dried in a drying oven.

The particular details of the coating method will depend upon the particular apparatus employed. In general, the method is implemented as a free meniscus coating process, such as a dip or withdrawal coating process, a slot coating process, or a drainage process. The processes may be batch or continuous. In general, in free meniscus coating processes, the substrate is withdrawn from the liquid into a gas atmosphere, the withdrawal entraining the liquid in a viscous boundary layer that splits into two portions at the free surface of the substrate. Between these two portions is a dividing line referred to as the stagnation line. The liquid portion next to the substrate ends up in the final film formed on the substrate as it is further withdrawn from the liquid, whereas the liquid portion on the other side of the stagnation line is returned to the bath by gravity. The stagnation line is analogous to a metering element such as a blade, knife, or roller. Thus, the present invention may also be employed with processes that use a metering element rather than a stagnation line, as discussed below. In general, in the free meniscus process, the substrate is drawn at a uniform rate of speed from the first phase to the second phase (generally in a substantially vertical direction) so that a uniform meniscus is formed and a uniform film of the first phase material is formed on the substrate along the surface portion to be coated. Drying or removal of the solvent portion of the first phase material then deposits the coating component as a uniform film on the surface portion of the substrate. Alternatively, the drying or removal of the solvent portion of the first phase results in a foamed coating, leaving pores that are continuous or discontinuous in the coating. This can be effected by rapid pressure release or temperature increase.

A first embodiment of an apparatus of the invention employing drainage as the withdrawal means is illustrated in FIG. 1. This figure is discussed in greater detail in Example 1 below. With a drainage method, the apparatus can include a pumping system in conjunction with the drain line to more precisely control the rate of drainage.

Figure 5:
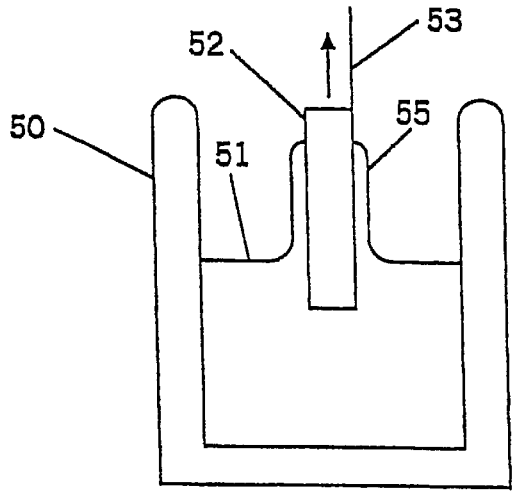
FIG. 5 illustrates a withdrawal or dip free meniscus coating method of the present invention.

A withdrawal or dip coating apparatus for carrying out the present is schematically illustrated in FIG. 5. The vessel 50 contains as a first phase liquid or supercritical fluid comprising carbon dioxide and a coating component 51. The substrate 52 is held in the solution by a clamp 53 while the vessel is filled. Once the vessel is filled, the substrate is withdrawn from the bath by an electrical or mechanical withdrawal mechanism secured to the upper portion of the vessel and connected to the clamp, forming a meniscus 55 along the surface portion to be coated.

Figure 6:
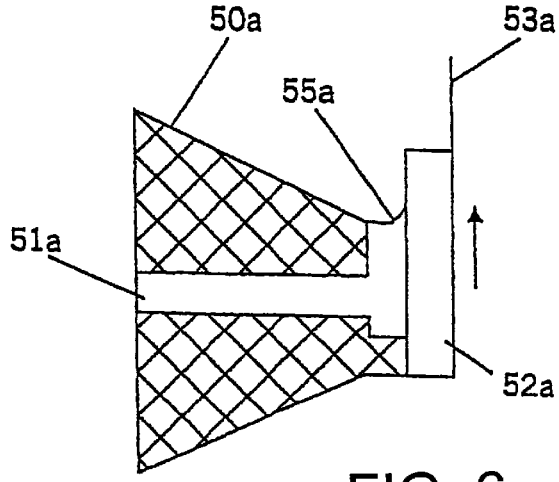
FIG. 6 illustrates a slot free meniscus coating method of the present invention.

A slot coating apparatus is schematically illustrated in FIG. 6. Slot coating is to be considered one type of continuous withdrawal coating herein. The supply nozzle serves as a vessel 50*a* that contains a liquid or supercritical fluid first phase comprising carbon dioxide and a coating component 51*a*. The substrate 52*a* is held with the surface portion to be coated adjacent the liquid by a clamp 53*a* or other carrying means (table, conveyor belt, spool assembly etc.). The substrate is drawn across the liquid or supercritical fluid 51*a* by an electrical or mechanical drawing mechanism, forming a meniscus 55*a* along the surface portion to be coated.

Figure 7:
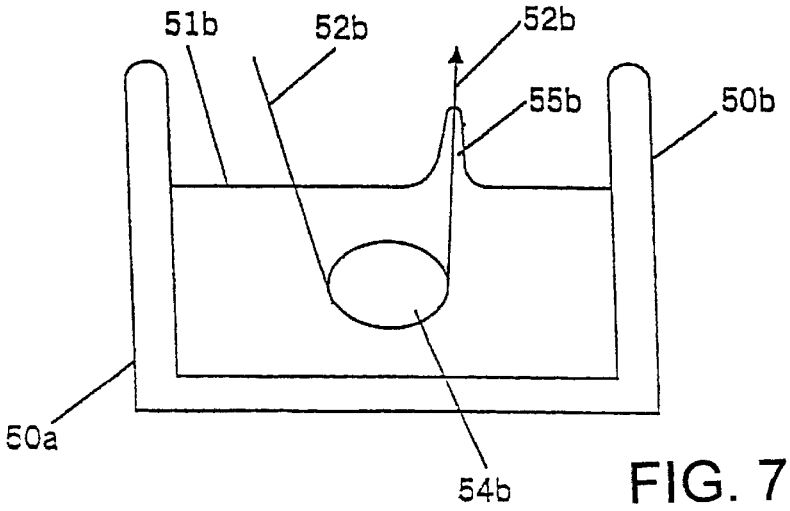
FIG. 7 schematically illustrates a continuous withdrawal free meniscus coating method of the present invention.

A continuous withdrawal or dip coating apparatus for carrying out the present is schematically illustrated in FIG. 7. As in FIG. 5, the vessel 50*b* contains a liquid or supercritical fluid comprising carbon dioxide and a coating component 51*b*, which serves as the first phase. The substrate 52*b* is held in the solution by a conveying assembly, that includes a roller 54*b* positioned within the bath. The substrate is continuously drawn from the bath by the conveying assembly, forming a meniscus 55*b* along the surface portion to be coated.

In the foregoing apparatus of FIGS. 5–7, supply vessels, supply and drainage lines, heaters, pressure pumps, refrigeration coils, temperature and pressure transducers, control mechanisms, stirring mechanisms and the like may be incorporated as needed to control the atmosphere of the second phase and the conditions of the first phase.

Figure 8:
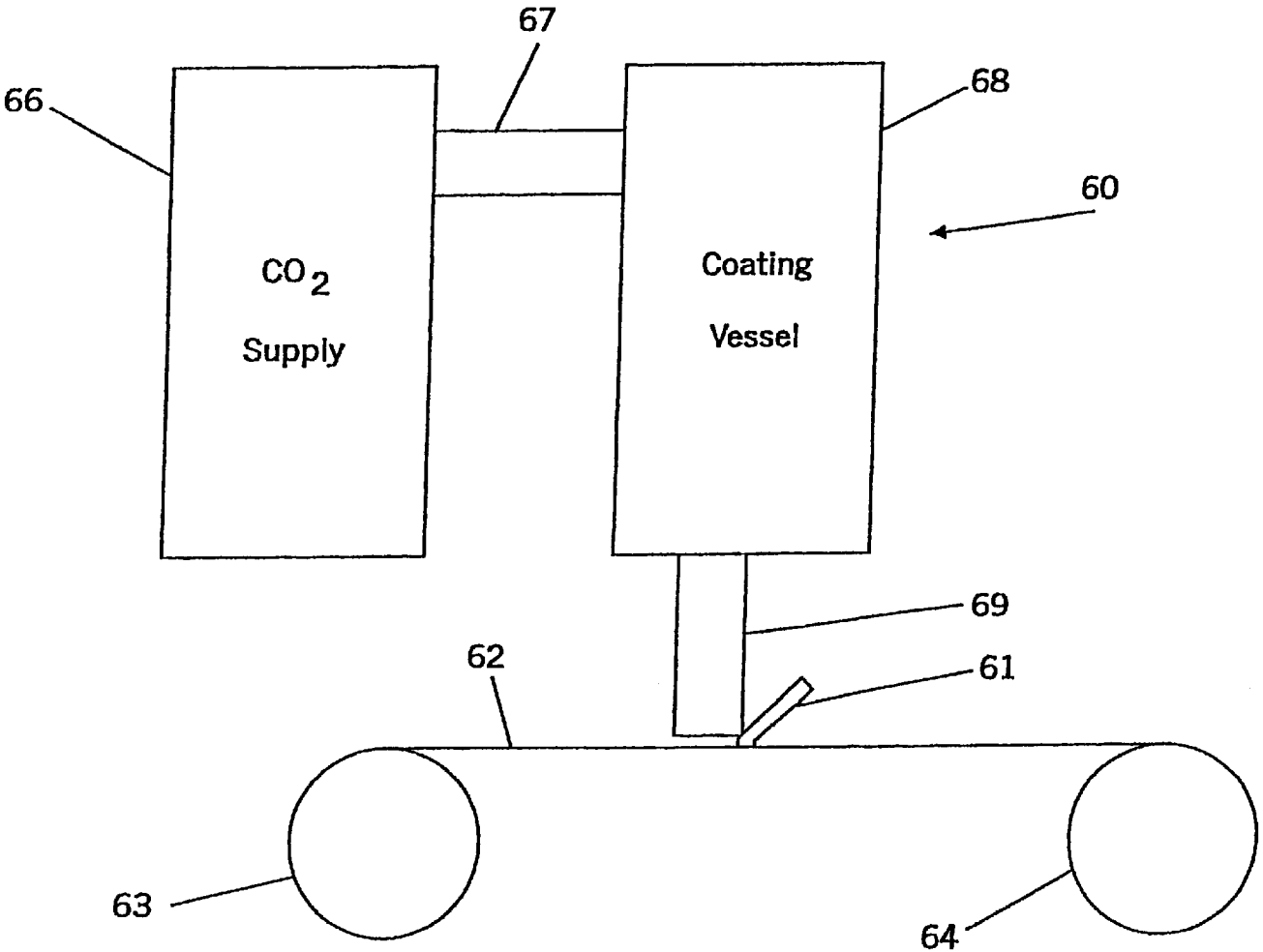
FIG. 8 illustrates a continuous coating method of the invention where a blade or knife serves as a metering element of the coating material rather than the stagnation line of a free meniscus coating method.
Figure 9:
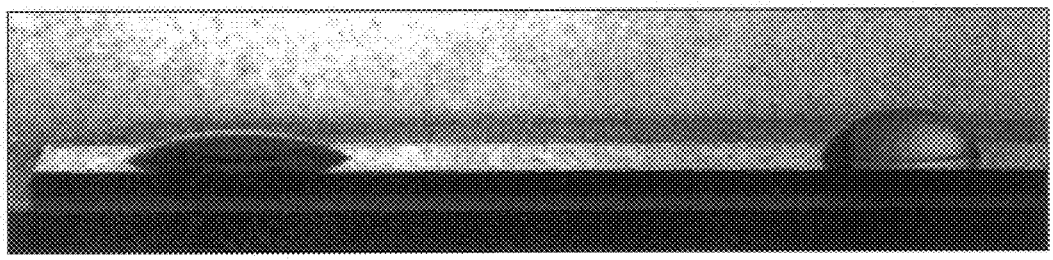
FIG. 9 illustrates (poly)methylmethacrylate ("PMMA") coatings formed according to methods of the invention, namely water on the PMMA after cleaning with a solvent and water on PMMA.

The continuous coating apparatus 60 of FIG. 8 employs a metering element 61 which as illustrated is a knife or blade, but could also be a roll or any other suitable metering element. The substrate 62 is continuously moved from a supply roll or spool 63 to a take up roll or spool 64, which together serve as a substrate supply means. Any other substrate supply means could be used, such as a conveyor assembly, table with motorized control elements, and the like. A high pressure carbon dioxide vessel 66 supplies carbon dioxide via line 67 to a high pressure coating vessel 68, in which carbon dioxide and a coating component are mixed. Impellers or other mixing means can be included in the coating vessel, and supply lines for the coating component and other ingredients can also be included into the coating vessel. A feed line 69 connected to the coating vessel supplies the first phase to the substrate, where thickness of the application is controlled by the metering element 61. Depending upon whether the first phase is a liquid or supercritical fluid, the process may be carried out within or outside of a pressure vessel, pressure reduction chambers or baffles may be provided, an air curtain or the like may be provided, etc.

In general, the apparatus is configured so that the substrate is withdrawn from the first phase into an atmosphere comprising or consisting essentially of carbon dioxide at a pressure greater than atmospheric pressure. The atmosphere may comprise or further comprise an inert gas, such as nitrogen. The atmosphere may comprise carbon dioxide at a pressure of 10 to 10,000 psi. Temperature and/or pressure control of the vessel in which coating is carried out is preferably provided to maintain a differential partial pressure of carbon dioxide between said first phase and the second phase/atmosphere of between about 10 and 400 mm Hg.

For solid articles such as metal, stone, ceramic, semiconductor articles and the like, batch or continuous withdrawal coating, drainage coating, or continuous coating with a metering element (FIG. 8) may be used.

For fibers, continuous dip coating is preferred. It is particularly preferred that fibers be provided as a spool of fiber material, which can then be continuously unwound into the first phase, continuously withdrawn into the second phase, and then continuously rewound for subsequent use.

For fabrics, paper, or wood substrates, continuous dip coating or continuous coating with a metering element is preferred. It is particularly preferred that fabrics be provided as a roll of unfinished fabric material, which can then be continuously unwound into the first phase, continuously withdrawn into the second phase, and then continuously rewound for subsequent finishing. Wallpaper and carpets can be treated by a similar process.

While the present invention has been described with carbon dioxide (which is most preferred) as the liquid, any material that is a gas at standard temperature and pressure (STP) but can be transformed to a liquid or a supercritical fluid under increased (i.e., super atmospheric) pressure can be used in combination with, or instead of the, carbon dioxide liquid in the present fluid. The liquid preferably is one that is not harmful to the atmosphere and is non-toxic towards humans, animals, and plants when vented or released. Other such fluids include $CO_2$, hydrofluorocarbons (HFCs) and perfluorocarbons (e.g., perfluoropropane and perfluorocyclobutane) that are gasses at STP, hydrocarbons that are gases at STP, polyatomic gases, noble gases, and mixtures thereof. Useful polyatomic gases include $SF_6$, $NH_3$, $N_2O$, and CO. Most preferred reaction fluids include $CO_2$, HFCs, perfluorocarbons, and mixtures thereof. Examples of useful HFCs include those that are known to be good solvents for many small organic compounds, especially those HFCs that comprise from 1 to 5 carbon atoms. Specific examples include 1,1,2,2-tetrafluoroethane, 1,1,1,2-tetrafluoroethane, trifluoromethane, and 1,1,1,2,3,3,3-heptafluoropropane. Compatible mixtures of any two or more of the foregoing also can be used as the fluid. $CO_2$ is most preferred, and where mixtures are employed then mixture that comprise at least about 40 or 60 percent $CO_2$ are preferred.

The present invention is explained in greater detail in the following non-limiting Examples.

EXAMPLE 1

Coating Apparatus and Preparation

The purpose of this series of experiments was to determine whether carbon dioxide can be used as a free meniscus coating solvent. The apparatus used is show in FIG. 1 (above). The apparatus 10 comprises an upper high pressure cell 11 and a lower high pressure cell 12. Piping is by 1/16 inch stainless steel tubing. A magnetic stirrer 13 is provided for use in conjunction with a stir bar placed in the lower cell. The apparatus is supported by a support stand 20 and adjustable holders 21. The substrate is held in place with a chuck that is secured to a clamp, and the clamp is connected to the interior of the cell. A pressure sensor 22 and temperature sensor 22 are included, and also connected to respective cells by 1/16 inch stainless steel tubing 24, 24*a*, 24*b*, 25 (shown as dashed lines).

The cells can be filled with carbon dioxide from a carbon dioxide pump (not shown) through lines 30, 30*a*, 30*b* and valves 6 and 7. The fluid can be drained from the top high pressure cell (substrate cell) 11 to the bottom high pressure cell (Solution Cell) 12 along drainage line 31 through valve 1. In the inverted position, fluid can be drained from solution cell 12 to the substrate cell 11 through line 32 and valve 2. When emptied of liquid, cell 11 can be vented through line 33 and valve 3.

The pressure transducer was obtained from Sensotec—Model #060-3147-01; the temperature controller was obtained from Omega—CN76000. Valves 1,2, and 3 were obtained from High Pressure Equipment Company—Model #15-11AF1. Valve 6/7 and valve 4/5 were obtained from High Pressure Equipment Company—Model #15-15AF1. The magnetic sStirrer was from LTE Scientific—Catalogue #333-0160-0. The carbon dioxide source pump was obtained from Isco—260D Syringe Pump and Series D Controller. Carbon dioxide gas was obtained from National Specialty Gases, and the substrate (glass slide) was from VWR Scientific Products—Catolog #48311-720.

In use, the solution apparatus is cleaned with hot water and then thoroughly scrubbed with acetone. After scrubbing, the cell is sprayed with acetone and allowed to dry. After cleaning, the cell is filled to 900 psi with carbon dioxide and purged. After purging, the cells are filled to 1800 psi and left overnight to dissolve contaminants. After sealing all leaks, the system is purged to atmospheric conditions.

Seven glass slides are cleaned with warm water and dried with a wipe. Each slide is then cleaned with acetone and dried with a wipe. Finally, each slide is sprayed with acetone. After cleaning the slides are placed within clean weigh boats so that they are suspended above the surface and left at room temperature.

The apparatus is placed in a refrigerator until use and then withdrawn. The glass slide is sprayed with acetone and placed in the substrate cell. Poly[1,1-dihydroperfluorooctyl methacrylate] (PolyFOMA) is weighed in four separate samples and the solution cell is filled with those samples (total 0.6047 g) to provide a two weight percent solution, and a magnetic stirrer, and the apparatus returned to a refrigerator at T=5.8° C. The apparatus is removed from the refrigerator and the solution cell filled to 400 psig and evacuated so as not to lose polymer. This is done twice. The substrate cell is filled to 2000 psig and evacuated to clean the apparatus and evacuated to clean the apparatus and slide, and the solution cell is brought to 619 psig. The solution cell is then filled with liquid carbon dioxide at 720 psig to the top inlet and the apparatus placed back in the refrigerator at T=16.1° C. the magnetic stirrer is turned on and the solution is left overnight to allow the polymer to dissolve. The same solution is used for the three runs described below.

EXAMPLE 2

Pressure Release Rate of 1.4 Psi Per Second

Figure 2:
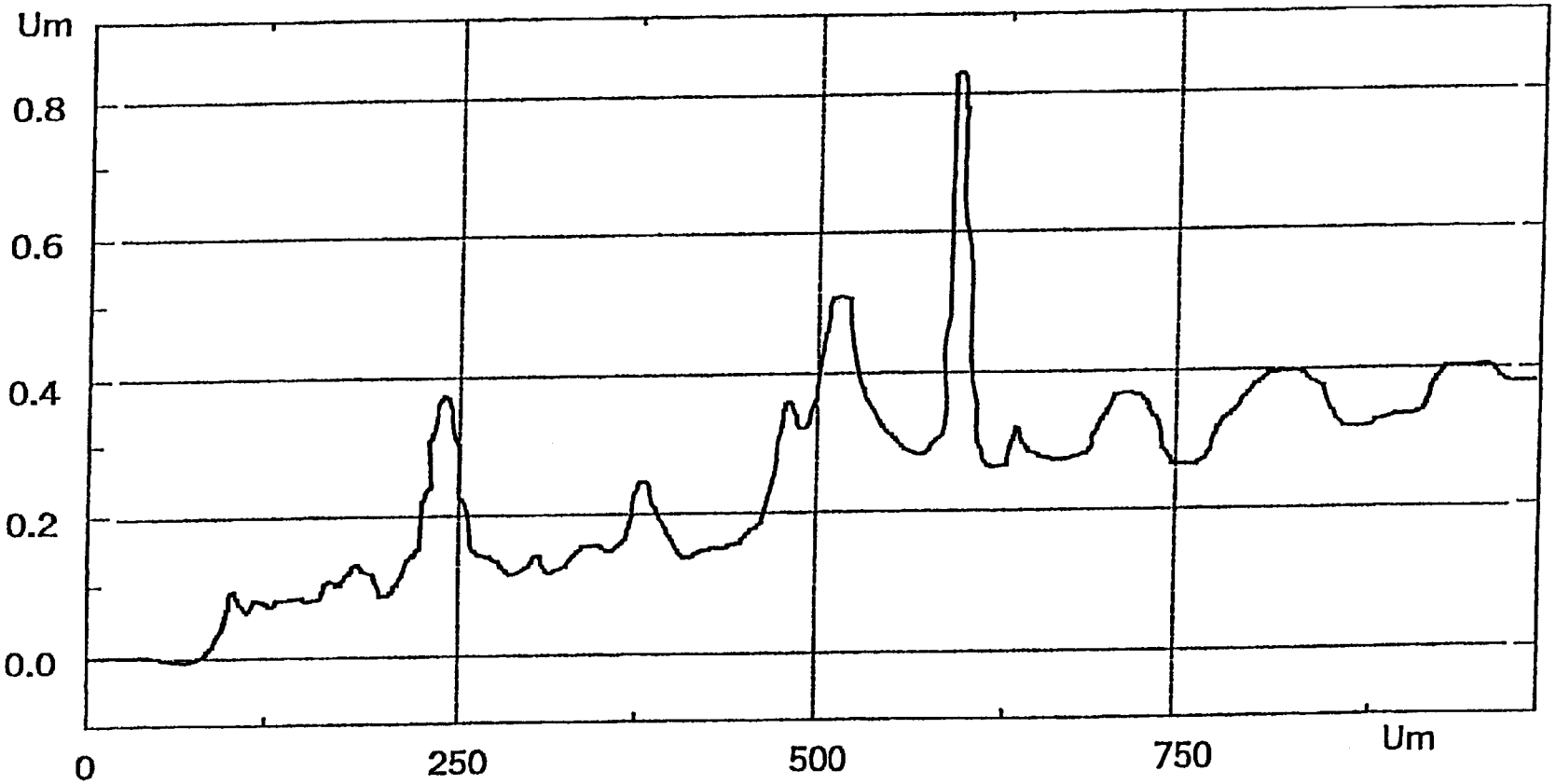
FIG. 2 is a profileometry illustration of a first glass slide coated with polymer by a method of the present invention, with the pressure release rate from the pressure vessel at an average rate of 1.4 psi per second. Sampling was done across the slide in a vertical direction. The maximum thickness of the coating was 0.82 $\mu$m; the minimum thickness of the coating was 0.10 $\mu$m. Both the horizontal and vertical axis are in $\mu$m.
Figure 3:
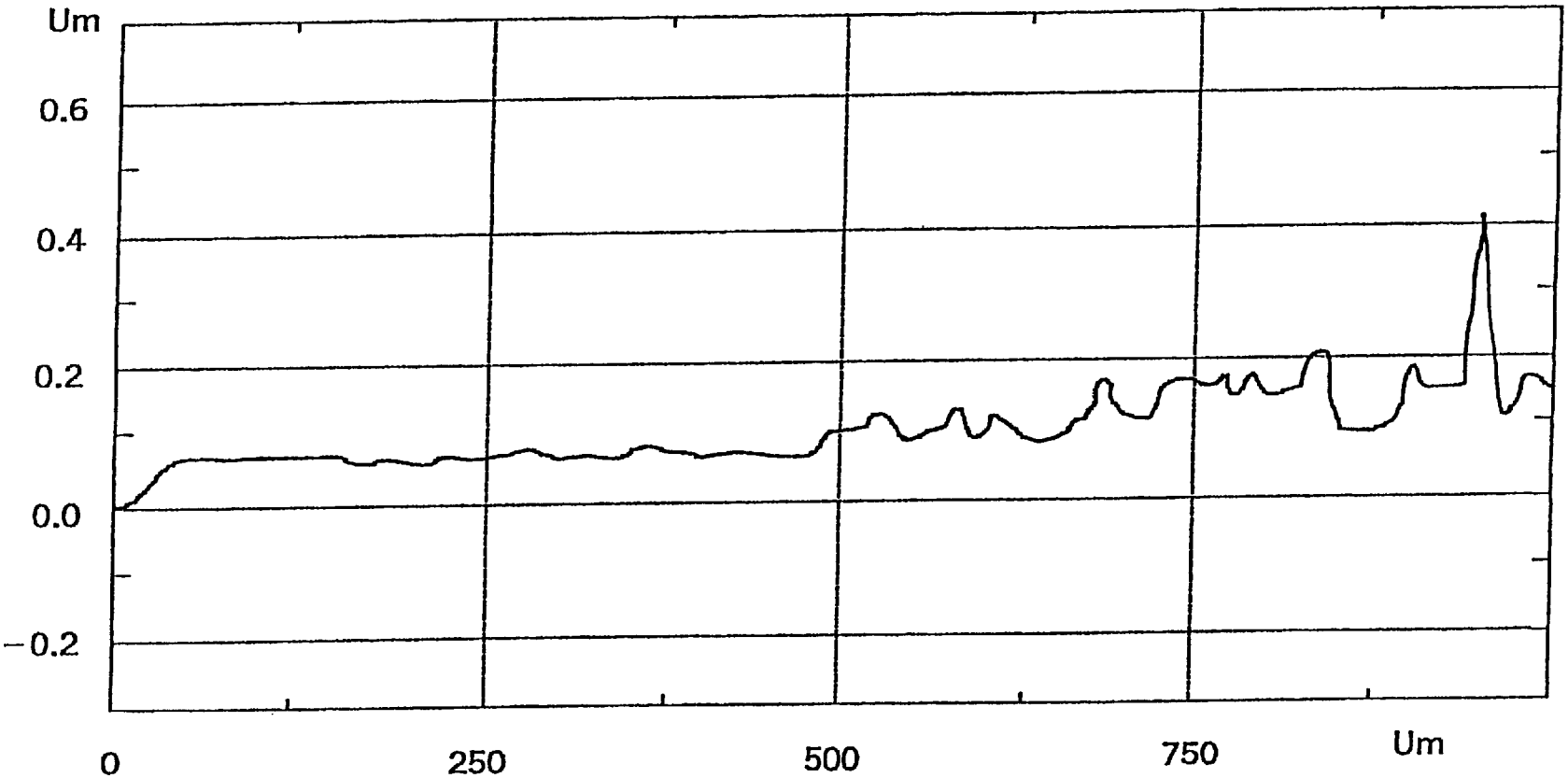
FIG. 3 is a profileometry illustration of the same glass slide described in FIG. 1, with sampling done across the slide in a horizontal direction. The maximum thickness of the coating was 0.41 $\mu$m; the minimum thickness of the coating was 0.13 $\mu$m. Both the horizontal and vertical axis are in $\mu$m.

The apparatus in the refrigerator is filled with clear $CO_2$ and polymer solution at a temperature of 9.1° C. and a pressure of 611 psig. The apparatus is removed from the refrigerator and inverted to allow the liquid to drain to the substrate cell. After about 2 minutes the valves are closed and the apparatus is set upright. The cell is placed back in the refrigerator, the pressure transducer is closed and the system allowed to stabilize. Once the solution has no ripples on the top, drainage is begun by opening valves 1 and 2. After 1 minute and six seconds the drainage valves are closed and the substrate cell isolated, the transducer is opened at the top cell and evacuation is begun at a slow rate of 1.4 psi per second. The glass slide is removed from the apparatus and all valves are closed. A thin film of polymer is found on the glass slide, as illustrated in FIG. 2 and FIG. 3.

EXAMPLE 3

Pressure Release Rate of 0.89 Psi Per Second

Figure 4:
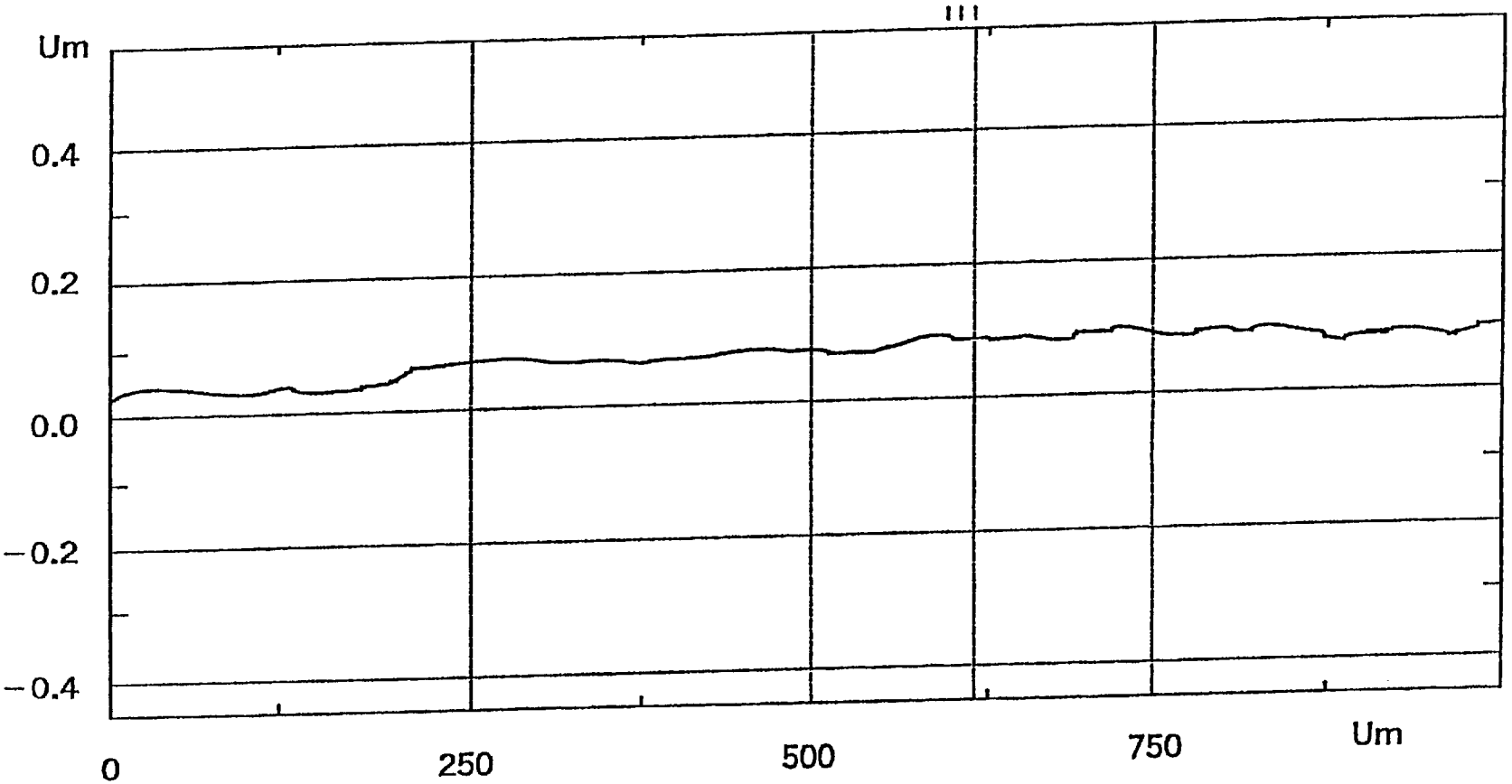
FIG. 4 is a profileometry illustration of a second glass slide coated with polymer by a method of the present invention, with the pressure release rate from the vessel at an average of 0.89 psi per second. The sampling was done across the slide in a vertical direction. Note the smooth uniform surface, with a maximum thickness of 0.14 $\mu$m and a minimum thickness of 0.13 $\mu$m. Both the horizontal and vertical axis are in $\mu$m.

This example is carried out in essentially the same manner as Example 2 above, with the same solution in the apparatus as used in Example 2. The cells were equilibrated at a temperature of 10.4° C. and a pressure of 606 psig. The solution was found to be cloudy, and was allowed to become clear and stable before drainage was begun. Drainage was carried out for one minute and twenty seconds. After the drainage valves are closed, the substrate cell is isolated and evacuation begun at a rate of 0.89 psi/second. The glass slide was removed from the cell. A thin film of polymer is found on the glass slide, as illustrated in FIG. 4. Further reuse of the polymer solution did not result in coated slides, apparently because of the dilution of the solution for these runs.

EXAMPLE 4

Coating and Polymerizing Methyl Methacrylate (MMA)

Methyl methacrylate (MMA) was coated on a substrate and polymerized in-situ in accordance with the present invention. This example was carried out at ambient temperature using carbon dioxide at a pressure of 860 psi. 2.5 mole percent of azobisisobutyronitrile (AIBN) was employed as initiator relative to the monomer amount. 6 weight percent of MMA was polymerized relative to the weight of carbon dioxide and the resulting (poly) methylmethacrylate coating had a thickness of approximately 180 Å.

The foregoing is illustrative of the present invention, and is not to be construed as limiting thereof. Accordingly, the invention is defined by the following claims, with equivalents of the claims to be included therein.

We claim:

1. A method of coating a substrate, comprising:

immersing a surface portion of a substrate in a first phase comprising at least one polymeric precursor and a supercritical fluid or liquid that is a gas at standard temperature and pressure; then withdrawing said substrate from said first phase into a distinct second phase comprising carbon dioxide so that said at least one polymeric precursor is deposited on said surface portion; and then subjecting the substrate to conditions sufficient to polymerize the at least one polymeric precursor and form a polymerized coating.

2. A method according to claim 1, wherein said second phase is a gas.

3. A method according to claim 1, wherein said first phase is homogeneous.

4. A method according to claim 1, wherein said first phase is heterogeneous.

5. A method according to claim 1, wherein said substrate is a solid article.

6. A method according to claim 1, wherein the at least one polymeric precursor is selected from the group consisting of acrylic monomers, polyfunctionial small molecules, multifunctional monomers, isocyanate-containing precursors, lipids, fatty acids, and combinations thereof.

7. A method according to claim 1, wherein the at least one polymeric precursor is methyl methacrylate.

8. A method according to claim 1, wherein said subjecting step is performed in-situ.

9. A method according to claim 1, wherein said subjecting step is performed ex-situ.

10. A method according to claim 1, wherein the first phase further comprises a biological material, and wherein said biological material is present within said polymerized coating.

11. A method according to claim 10, wherein said biological material is selected from the group consisting of proteins, peptides, amino acids, nucleic acids, cellular material, lipids, fatty acids, bacteria, viruses, and combinations thereof.

12. A method according to claim 1, wherein said substrate comprises a porous material, and wherein said substrate and said polymerized coating are present in the form of an integral composite structure.

13. A method according to claim 12, wherein the porous material is selected from the group consisting of filler, powder, fibers, granules, metal particles, and combinations thereof.

14. A method according to claim 1, wherein said first phase further comprises a viscosity modifier.

15. A method according to claim 1, wherein said first phase further comprises a surface-tension modifier.

16. A method according to claim 1, wherein said withdrawing step is carried out by withdrawing said substrate from said first phase into an atmosphere comprising carbon dioxide at a pressure greater than atmospheric pressure.

17. A method according to claim 1, wherein said withdrawing step is carried out by withdrawing said substrate from said first phase into an atmosphere comprising carbon dioxide at a pressure of 10 to 10,000 psi.

18. A method according to claim 1, wherein said withdrawing step is carried out by withdrawing said substrate from said first phase into an atmosphere comprising carbon dioxide, said method further comprising the step of:

maintaining a differential partial pressure of carbon dioxide between said first phase and said atmosphere of between about 10 and 400 mm Hg.

19. A method according to claim 1, wherein the polymerized coating comprises at least one polymer selected from the group consisting of acrylate polymers, epoxies, polyisocyanates, polyurethanes, a sol-gel precursor, a polyimide, polyesters, polycarbonates, polyamides, polyolefins, polystyrene, acrylic latex epoxy resins, novolac resins, resole resins, polyurea, polyurea urethanes, polysaccharides, fluoropolymers, silicone resins, amino resins, poly(ethylene naphthalate), and combinations thereof.

20. A method according to claim 1, wherein said subjecting step is carried out in the presence of an initiator.

21. A method according to claim 1, wherein said substrate is a non-polymeric substrate.

22. A method according to claim 1, wherein said supercritical fluid or liquid that is a gas at standard temperature and pressure comprises carbon dioxide.

23. A method according to claim 1, wherein said supercritical fluid or liquid that is a gas at standard temperature comprises a supercritical fluid or liquid of a gas selected from the group consisting of carbon dioxide, hydrofluorocarbons, perfluorocarbons, hydrocarbons, polyatomic gases, and noble gases.

24. A method of coating a substrate, comprising:

immersing a surface portion of a substrate in a first phase comprising at least one polymeric precursor and a supercritical fluid or liquid that is a gas at standard temperature and pressure; then withdrawing said substrate from said first phase into a distinct second phase consisting essentially of carbon dioxide so that said at least one polymeric precursor is deposited on said surface portion; and then subjecting the substrate to conditions sufficient to polymerize the at least one polymeric precursor and form a polymerized coating.

* * * * *